US006534452B1

(12) United States Patent
Butler

(10) Patent No.: US 6,534,452 B1
(45) Date of Patent: Mar. 18, 2003

(54) LONG-LIFE LUBRICATING OIL WITH WEAR PREVENTION CAPABILITY

(75) Inventor: Kevin David Butler, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/041,321

(22) Filed: Jan. 8, 2002

Related U.S. Application Data

(60) Provisional application No. 60/279,092, filed on Mar. 27, 2001.

(51) Int. Cl.[7] ..... C10M 141/10; C10M 141/06
(52) U.S. Cl. ..... 508/430; 508/563
(58) Field of Search ..... 508/430, 563

(56) References Cited

U.S. PATENT DOCUMENTS

| | | | | | |
|---|---|---|---|---|---|
| 3,374,291 | A | * | 3/1968 | Myers | 508/430 |
| 3,839,507 | A | * | 10/1974 | Hechenbleikner et al. | 508/430 |
| 4,197,209 | A | * | 4/1980 | Zinke et al. | 508/430 |
| 4,333,841 | A | * | 6/1982 | Schmidt et al. | 508/430 |
| 4,544,492 | A | * | 10/1985 | Zinke et al. | 508/430 |
| 5,362,419 | A | * | 11/1994 | Zinke et al. | 508/430 |
| 5,922,657 | A | * | 7/1999 | Camenzind et al. | 508/430 |

* cited by examiner

*Primary Examiner*—Jacqueline V. Howard
(74) *Attorney, Agent, or Firm*—Paul E. Purwin

(57) ABSTRACT

An industrial lubricant having wear prevention properties without sacrificing oxidation resistance comprises a major portion of a base oil; an effective amount of a sulfur and phosphorus antiwear compound and an effective amount of an anti-oxidant or mixture of antioxidants.

6 Claims, No Drawings

LONG-LIFE LUBRICATING OIL WITH WEAR PREVENTION CAPABILITY

This application claims the benefit of U.S. Provisional Application No.: 60/279,092 filed Mar. 27, 2001.

FIELD OF INVENTION

This invention concerns lubricating compositions for use in industrial equipment requiting antiwear control. More particularly this invention concerns lubricating compositions providing load-carrying (antiwear) control for industrial equipment without sacrificing oxidation resistance.

BACKGROUND OF INVENTION

The art of lubricating oil formulation has become increasingly complex with ever more stringent industry standards dictated by developing industrial equipment technology. One requirement for industrial lubricants is to provide wear control. At the same time the lubricant formulation should provide resistance to oxidation and sludge formation in order to achieve operation life of adequate length. Experience has shown that the incorporation of one type of additive in a lubricant composition can have a negative impact on the function of another type of additive in that composition. Indeed, the presence of antiwear additives in lubricants often reduces the oxidation stability and increases sludge formation compared to a similar oil where the antiwear additive is absent. Thus, there is a need for industrial lubricants that provide improved antiwear performance without sacrificing oxidation resistance and deposit control.

SUMMARY OF INVENTION

According to the invention, a lubricant composition especially suitable for use in industrial equipment requiring antiwear properties and oxidation resistance is provided, comprising a major portion of a base oil, an effective amount of both a sulfur and phosphorous containing antiwear additive, and an antioxidant or a mixture of antioxidants.

DETAILED DESCRIPTION OF INVENTION

The lubricant composition described herein comprises a major amount of a base oil of lubricating viscosity, a sulfur and phosphorus containing anti-wear additive, and a mixture of one or more antioxidant additives. Compressor, hydraulic, turbine or other industrial lubricating compositions can be formulated using this combination of components.

The lubricating oil base stock is any natural or synthetic lubricating base oil stock fraction typically having a kinematic viscosity at 40° C. of about 14 to 220 cSt, more preferably about 20 to 150 cSt, most preferably about 32 to 68 cSt.

The lubricating oil basestock can be derived from natural lubricating oils, synthetic lubricating oils or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude. Suitable basestocks include those in API categories I, II and III, where saturates level and Viscosity Index are:

Group I—less than 90% and 80–120, respectively;

Group II—greater than 90% and 80–120, respectively; and

Group III—greater than 90% and greater than 120, respectively.

Natural lubricating oils include petroleum oils, mineral oils, and oils derived from coal or shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with variety of alcohols. Esters useful as synthetic oils also include those made from $C_5$ to $C_{12}$ monocarboxylic acids and polyols and polyol ethers.

The lubricating oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydro-isomerization catalyst.

Natural waxes are typically the slack waxes recovered by the solvent dewaxing of mineral oils; synthetic waxes are typically the wax produced by the Fischer-Tropsch process.

The resulting isomerate product is typically subjected to solvent dewaxing and fractionation to recover various fractions of specific viscosity range. Wax isomerate is also characterized by possessing very high viscosity indices, generally having a VI of at least 130, preferably at least 135 and higher and following dewaxing, a pour point of about −20° C. and lower.

The production of wax isomerate oil meeting the requirements of the present invention is disclosed and claimed in U.S. Pat. Nos. 5,049,299 and 5,158,671 which are incorporated herein by reference.

The compositions of the invention include an effective amount of a sulfur and phosphorus containing antiwear compound or additive. A preferred additive is an alkylated ester derivative of a sulfurized phosphite or phosphate. A more preferred additive compound has the formula I:

(1)

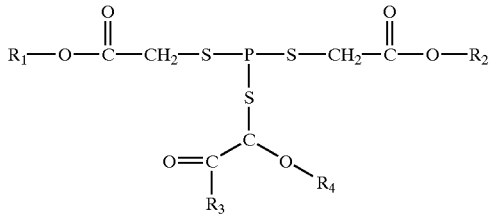

where $R_1$, $R_2$, $R_3$ and $R_4$ may be the same or different hydrocarbyl groups of from about 1 to about 18 carbon atoms. Preferably $R_1$ and $R_2$ are the same and are branched alkyl groups of from about 6 to about 10 carbon atoms, $R_3$ is an alkyl group of from about 1 to about 4 carbon atoms, and $R_4$ is an alkyl group of from about 6 to about 10 carbon atoms. Typically the antiwear additive will comprise from about 0.05 to about 2.5 wt %, based on the total weight of the composition.

The lubricant composition of the invention also includes an effective amount of an antioxidant or mixtures of antioxidants, such as aryl amines, phenylene diamines, hindered phenolics and thiocarbamates, or derivatives thereof, which may or may not be sulfurized. A preferred embodiment of the is invention incorporates an effective amount of aromatic amine anti-oxidant or mixture of aromatic amine antioxidants. Aromatic amine antioxidants useful in the present invention are selected from the aromatic amines and mixtures thereof represented by formulae II and III.

(II)

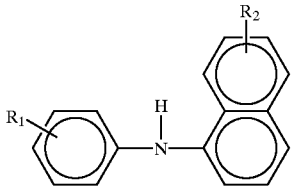

(III)

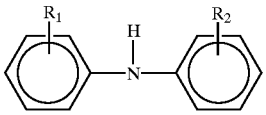

where $R_1$ and $R_2$ are independently hydrogen or $C_1$ to $C_{18}$ alkyl. Typically the amine or mixture of amines will constitute from about 0.05 to about 2.5 wt %, based on the weight of the composition. An especially preferred composition includes amines of formula II and III in the weight ratio of about 0.2 to about 4.0. Indeed, a most preferred composition includes amine II in which $R_1$ and $R_2$ are hydrogen, and amine III in which $R_1$ and $R_2$ are $C_4$ to $C_8$ alkyl.

Fully formulated industrial oils typically may also contain additional additives, known to those skilled in the industry, used on an as-received basis. The lubricating oils of the present invention may contain, in addition to the aforesaid antioxidant and antiwear additives, other additives typically used in lubricating oils, such as pour depressants, rust inhibitors, thickeners, metal passivators, demulsifiers and antifoamants.

Pour depressant additives for lubricating oils are typically polymers or co-polymers, with polymethacrylates and polyvinlyacetate alkylfumarate as commonly used examples. Rust inhibitor additives can be of a variety of chemical types, with ester and amide derivatives of alkylated succinic acid being among the most commonly used in lubricating oils. Thickeners may be any oligomer, polymer or co-polymer which can be employed to increase the viscosity of the oil in a controlled manner. Such materials include hydrocarbons, such as polybutenes, olefin copolymers and high viscosity poly-alpha olefins, and polyalkyacrylates, such as polymethacrylates and olefin-acrylate co-polymers.

Metal passivators can be of a wide variety of chemical types which interact with metals typically present in lube systems to prevent such metals from exercising a deleterious effect on the functionality of the lubricant. Commonly used metal passivators include thiazines, triazoles, benzotriazoles and dimercaptothiadiazoles, including alkyl and other derivatives, and mixtures thereof. Demulsifiers are employed to enhance the rapid separation of oil and water in lube systems, and most often consist of poly-oxyalkylated derivatives of multi-hydroxyl substrates such as sugars. Poly-acrylates and poly-alkylsiloxanes, and their derivatives, are widely employed in lubricants as antifoamants.

Materials such as these are well known in the art. Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pages 1–11.

The following non-limiting Examples and Comparative Examples illustrate the invention.

EXAMPLES

Lubricant compositions were prepared based on the ingredients shown in Table 1 below.

TABLE 1

| Component Function | Component Type | Example 1 | Comparative Example 1 | Comparative Example 2 | Example 2 | Example 3 | Example 4 |
|---|---|---|---|---|---|---|---|
| ISO Viscosity Grade | | 32 | 32 | 32 | 46 | 68 | 68 |
| Components (wt %) | | | | | | | |
| Basestock SN 90 | API Group II | 34.755 | 34.601 | 37.448 | — | — | — |
| Basestock SN 250 | API Group II | 63.96 | 64.563 | 62.00 | 95.965 | 47.00 | 69.365 |
| Basestock SN 600 | API Group I | — | — | — | 2.750 | 51.715 | 25.85 |
| Thickener | Poly-isobutylene | — | — | — | — | — | 3.5 |
| Anti-oxidant | Phenyl naphthyl amine | 0.4 | 0.5 | — | 0.4 | 0.4 | 0.4 |
| Anti-oxidant | Octyl-phenyl naphthyl amine | — | — | 0.3 | — | — | — |
| Antioxidant | N-butyl-N-octyl Diphenylamine Alkylated ester | 0.22 | — | — | 0.22 | 0.22 | 0.22 |

TABLE 1-continued

| Component Function | Component Type | Example 1 | Comparative Example 1 | Comparative Example 2 | Example 2 | Example 3 | Example 4 |
|---|---|---|---|---|---|---|---|
| Antiwear | derivative of tri-thiophosphite | 0.33 | — | — | 0.33 | 0.33 | 0.33 |
| Balance of Additive System | Additive blend | 0.335 | 0.336 | 0.252 | 0.335 | 0.335 | 0.335 |

(1) A compound of Formula 1 with $R_1$, $R_2$ and $R_4$ having 8 carbon atoms and $R_2$ having 2 carbon atoms.

These compositions were then subjected to industry standard tests for air compressors (DIN 51506, DIN 51532/2 (Pneurop oxidation) and DIN 51356), and some were also subjected to proposed heavy duty vane and screw compressor test performance standards within ISO L-DAJ (ISO/DIS 6521). Other laboratory and performance tests were also conducted. These tests and their results are shown in Table 2. Industry standards are also included in Table 2.

Industrial oils formulated according to the preferred embodiments of this invention have been tested in compressor equipment, and the condition of the oils sampled during service are shown in accompanying tables.

In one test an ISO VG 46 grade oil was run in an Atlas-Copco 200 HP GA rotary screw compressor in routine industrial service over a period of 5 months. Results from testing of oils sampled from the compressor lube system at regular intervals are shown in Table 3, with Total Acid

TABLE 2

| Test Description | Test Reference | Units | Example 1 | Comparative Example 1 | Comparative Example 2 | Example 2 | Example 3 | Example 4 | Industry Standard |
|---|---|---|---|---|---|---|---|---|---|
| Kin. viscosity @ 40° C. | | cSt | 31.63 | 32 | 32.12 | 44.85 | 65.26 | 66.71 | |
| Viscosity Index | ASTM D | | 117 | 117 | 117 | 116 | 106 | 125 | |
| Copper Corrosion | ASTM D130 | | — | — | 1a | 1b | — | — | 1b max. |
| Anti-rust Performance | ASTM D 665B | | no corrosion | — | no corrosion | no corrosion | no corrosion | no corrosion | no corrosion |
| Oxidation Life | ASTM D 2272 | minutes | 1708 | 1778 | 1745 | | | | |
| Oxidation Life | ASTM D 943 | hours | | >10,000 | 7102 | >8500 | — | — | >3000 |
| Oxidation Sludge | ASTM D 4310 | mg | — | — | 19 | 136 | — | — | <200 |
| Pneurop Oxidation | DIN 51352 part 2 | | | | | | | | |
| % weight loss | | wt % | 11.3 | | | 5.07 | 5.97 | 5.17 | ≦20 |
| % CCR | | wt % | 1.10 | | | 0.95 | 1.43 | 0.23 | ≦2.5 |
| ROCOT Oxidation | ISO/DIS 6521 | | | | | | | | |
| Evaporation loss | | | 3.95 | | | 2.10 | 1.89 | 2.21 | |
| Acid value | | | 0.18 | | | 0.32 | 0.38 | 0.31 | |
| Heptane insolubles | | | 0.13 | | | 0.8 | 0.21 | 0.15 | |
| kin. visc. increase | | | 6.5 | | | 4.8 | 7.0 | 6.3 | |
| Distillation 20% residue | DIN 51356 | | | | | | | | |
| kin. viscosity @ 40° C. | | cSt | 77.14 | | | 96.01 | 143.8 | 300.5 | <5 × new |
| % CCR | | wt % | 0.04 | | | 0.02 | 0.05 | 0.11 | ≦0.3 |
| 4-Ball wear | ASTM D 2266 | mm | 0.411 | — | 0.78 | 0.421 | | | |

As can be seen the compositions of the invention meet or significantly exceed the industry standards. In non-industry oil stability tests, such as ASTM D2272 and ASTM D943, and metal corrosion tests, such as ASTM D665B and ASTM D130, results were excellent, and comparable to the non-antiwear oil comparative examples. However, the examples of the invention show superior performance to the comparative examples in the ASTM D2266 four-ball wear test.

Number and kinematic viscosity being principal indicators of oil degradation. It can be seen that both of these properties changed very little during this period of operation, indicating that the oil was not significantly oxidatively degraded. The oil previously used in this compressor has historically been changed out every 1500 hours operation due to the level of oxidative degradation. At the same time, levels of iron and copper in the in the oil samples were very low,

TABLE 3

| Compressor run time (hours) | 0 | 22 | 565 | 1030 | 1610 | 2365 | 2846 | 3278 | 3649 |
|---|---|---|---|---|---|---|---|---|---|
| Kin. viscosity @ 40° C. | 45.61 | 45.42 | 46.30 | 47.00 | 47.37 | 47.55 | 47.96 | 48.17 | 48.57 |
| ASTM Color | 0.5 | 2.0 | 5.5 | 7.0 | 7.0 | 7.0 | 7.5 | <8.0 | <8.0 |
| Total Acid Number | 0.35 | 0.39 | 0.23 | 0.19 | 0.20 | 0.20 | 0.13 | 0.21 | 0.29 |
| Elements in oil (ppm) | | | | | | | | | |
| Iron | 0 | 0 | 0 | 0 | 0 | 0 | 0 | 0 | 0 |
| Copper | 0 | 13 | 2 | 5 | 4 | 2 | 2 | 4 | 6 |

demonstrating that essentially no wear or corrosion of metal parts occurred.

In another test an ISO VG 32 grade oil was run in a Gardner-Denver 50 HP rotary screw compressor in routine industrial air compression service. Results from testing of oils sampled from the compressor lube system at regular intervals are shown in Table 4. Again, very little change was seen in the kinematic viscosity and Total Acid Number properties of the oil, indicating insignificant oxidative degradation. No iron or copper were detected, demonstrating no wear or corrosion of metal parts.

TABLE 4

| Compressor run time (hours) | 0 | 5 | ~500 | 1098 | 1812 | 2628 | 3614 |
|---|---|---|---|---|---|---|---|
| Kinematic viscosity @ 40° C. | 31.69 | 31.87 | 33.22 | 33.68 | 34.54 | 34.77 | 34.97 |
| ASTM Color | 0.5 | <1.0 | 5.5 | 6.5 | <7.5 | 7.5 | 7.5 |
| Total Acid Number | 0.27 | 0.31 | 0.11 | 0.10 | 0.11 | 0.13 | 0.11 |
| Elements in oil (ppm) | | | | | | | |
| Iron | 0 | 0 | 0 | 0 | 0 | 0 | 0 |
| Copper | 0 | 0 | 0 | 0 | 0 | 0 | 0 |

What is claimed is:

1. A lubricant composition comprising:

a major portion of a base oil;

an effective amount of a sulfur and phosphorus antiwear additive having the formula I:

(1)

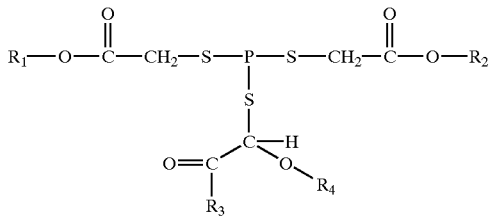

where $R_1$, $R_2$, $R_3$ and $R_4$ may be the same or different hydrocarbyl groups of from about 1 to about 18 carbon atoms; and an effective amount of an anti-oxidant or mixture of antioxidants selected from amines having formula II and III:

(II)

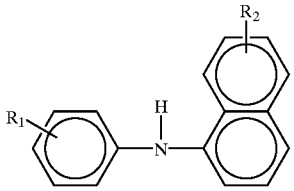

(III)

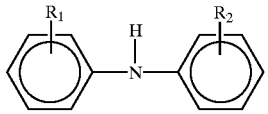

where $R_1$ and $R_2$ are independently hydrogen or $C_1$ to $C_{18}$ alkyl.

2. The composition of claim 1 wherein, in the antiwear additive of formula I, $R_1$ and $R_2$ are the same and are branched alkyl groups of from about 6 to about 10 carbon atoms, $R_3$ is an alkyl group of from about 1 to about 4 carbon atoms, and $R_4$ is an alkyl group of from about 6 to about 10 carbon atoms.

3. The composition of claim 2 wherein the anti-oxidant is a mixture of amines having formulae II and III, and in which $R_1$ and $R_2$ are hydrogen in formula II, and $R_1$ and $R_2$ are $C_4$ to $C_8$ alkyl in formula III.

4. The composition of claim 2 wherein the base oil is a mineral oil of API Groups II or III, or a mixture of oils of API Groups I and II or III and/or IV.

5. A method for improving the wear performance of an industrial lubricant which substantially retains the oxidation stability of the lubricant, by providing the lubricant with an effective amount of a sulfur and phosphorous antiwear additive having the formula I:

(1)

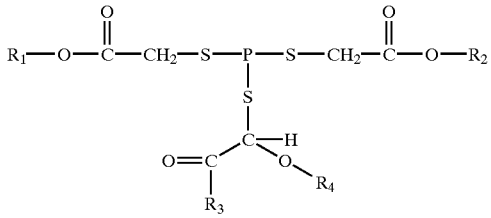

where $R_1$, $R_2$, $R_3$ and $R_4$ may be the same or different hydrocarbyl groups of from about 1 to about 18 carbon atoms; and an effective amount of an aromatic amine anti-oxidant or mixture of aromatic amine antioxidants are selected from amines having formula II and III:

(II)

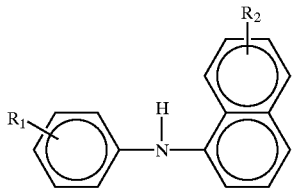

(III)

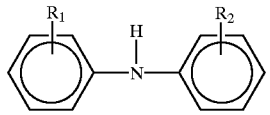

wherein $R_1$ and $R_2$ are independently hydrogen or $C_1$ to $C_{18}$ alkyl.

6. The method of claim 5 wherein in the antiwear addition of formula I $R_1$ and $R_2$ are the same and are branched alkyl groups of from about 6 to about 10 carbon atoms, $R_3$ is an alkyl group of from about 1 to about 4 carbon atoms, and $R_4$ is an alkyl group of from about 6 to about 10 carbon atoms, and wherein the anti-oxidant is a mixture of amines having formulae II and III, and in which $R_1$ and $R_2$ are hydrogen.

* * * * *